US012396541B2

(12) United States Patent
Coquard et al.

(10) Patent No.: US 12,396,541 B2
(45) Date of Patent: Aug. 26, 2025

(54) CASING FOR A REFILLABLE CONTAINER DEVICE FOR COSMETIC PRODUCT AND ASSOCIATED CONTAINER DEVICE

(71) Applicant: CHANEL PARFUMS BEAUTE, Neuilly-sur-Seine (FR)

(72) Inventors: Christophe Coquard, Neuilly sur Seine (FR); Floriane Peronne, Neuilly sur Seine (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 4 days.

(21) Appl. No.: 17/956,500

(22) Filed: Sep. 29, 2022

(65) Prior Publication Data

US 2023/0107932 A1 Apr. 6, 2023

(30) Foreign Application Priority Data

Sep. 30, 2021 (FR) ..... 2110306

(51) Int. Cl.
*A45D 40/00* (2006.01)
*B65D 77/04* (2006.01)

(52) U.S. Cl.
CPC ..... *A45D 40/0068* (2013.01); *B65D 77/0493* (2013.01)

(58) Field of Classification Search
CPC . A45D 40/0068; A45D 40/18; B65D 77/0493
(Continued)

(56) References Cited

U.S. PATENT DOCUMENTS 8,789,540 B2 * 7/2014 Lee ..... A45C 13/1084 206/823
2019/0281949 A1 * 9/2019 Eng ..... A45D 40/0068
(Continued)

FOREIGN PATENT DOCUMENTS

EP 0 661 012 A1 7/1995
FR 3 056 087 A1 3/2018
(Continued)

OTHER PUBLICATIONS

French Search Report issued in French Patent Application No. FR2110306, dated May 16, 2022.
(Continued)

*Primary Examiner* — Rafael A Ortiz
(74) *Attorney, Agent, or Firm* — GREENBLUM & BERNSTEIN, P.L.C.

(57) ABSTRACT

A refillable cosmetic product container device. The casing is configured to receive a refill configured to contain the cosmetic product. The casing includes an opening forming a casing neck and is configured to receive the refill in a reception volume defined by an inside wall of the casing. The casing further includes a ring connected to the neck, the ring at least partly covering a portion of the inside wall of the casing forming the neck. The ring includes an inside surface connected to a member of elastomer material which is at least partly in relief relative to the inside surface of the ring. The casing thus formed can hold a refill in the reception volume, by virtue of the members in relief of elastomer material formed on the inside surface of the ring. The invention also relates to a cosmetic product container device that includes such a casing and a refill.

15 Claims, 3 Drawing Sheets

(58) Field of Classification Search
USPC ..... 206/581; 220/23.89
See application file for complete search history.

(56) References Cited

U.S. PATENT DOCUMENTS

| | | | | |
|---|---|---|---|---|
| 2020/0275759 | A1 | 9/2020 | Chevalier | |
| 2021/0259389 | A1* | 8/2021 | Shen | A45D 40/0068 |
| 2021/0298451 | A1* | 9/2021 | Coquard | B65D 77/0493 |
| 2021/0339467 | A1* | 11/2021 | Fleischmann | B33Y 10/00 |
| 2021/0368964 | A1* | 12/2021 | Bickford | A45D 40/0068 |
| 2022/0211161 | A1 | 7/2022 | Del Din | |

FOREIGN PATENT DOCUMENTS

| | | | | |
|---|---|---|---|---|
| FR | 3 067 327 | A1 | 12/2018 | |
| FR | 3 101 066 | A1 | 3/2021 | |
| JP | 58-79555 | U | 5/1983 | |
| JP | 2013119399 | A | 6/2013 | |
| JP | 2015-126824 | A | 7/2015 | |
| WO | WO-2015115685 | A1 * | 8/2015 | H01L 33/0075 |
| WO | 2019/058087 | A1 | 3/2019 | |

OTHER PUBLICATIONS

English language translation of Office action from counterpart Japanese Patent Application No. 2022-156194, the Office action having a mailing date Aug. 15, 2023.

* cited by examiner

[Fig. 1]
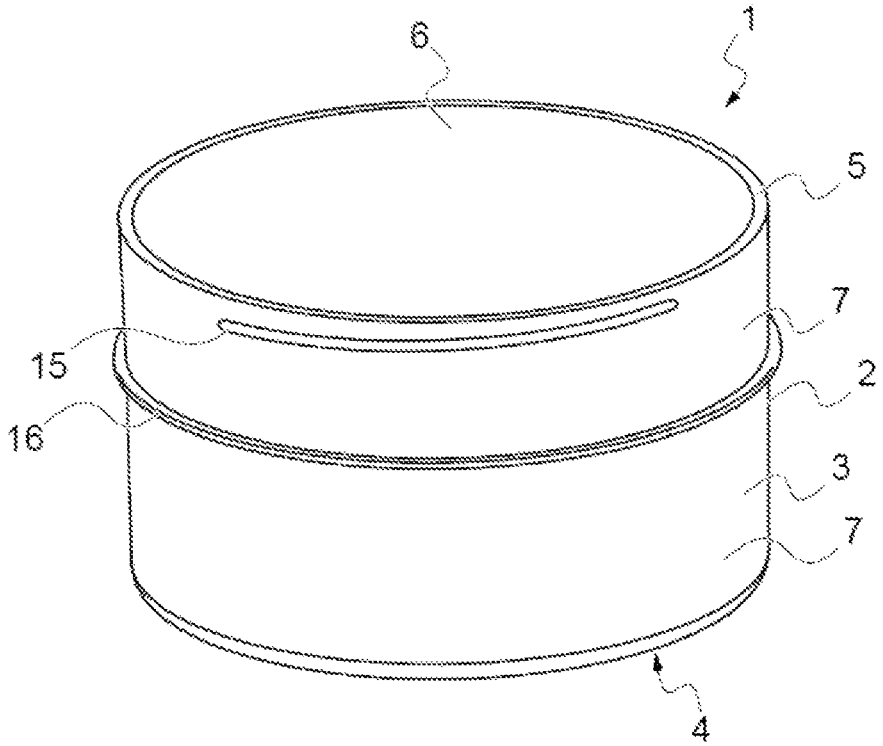
[Fig. 2]
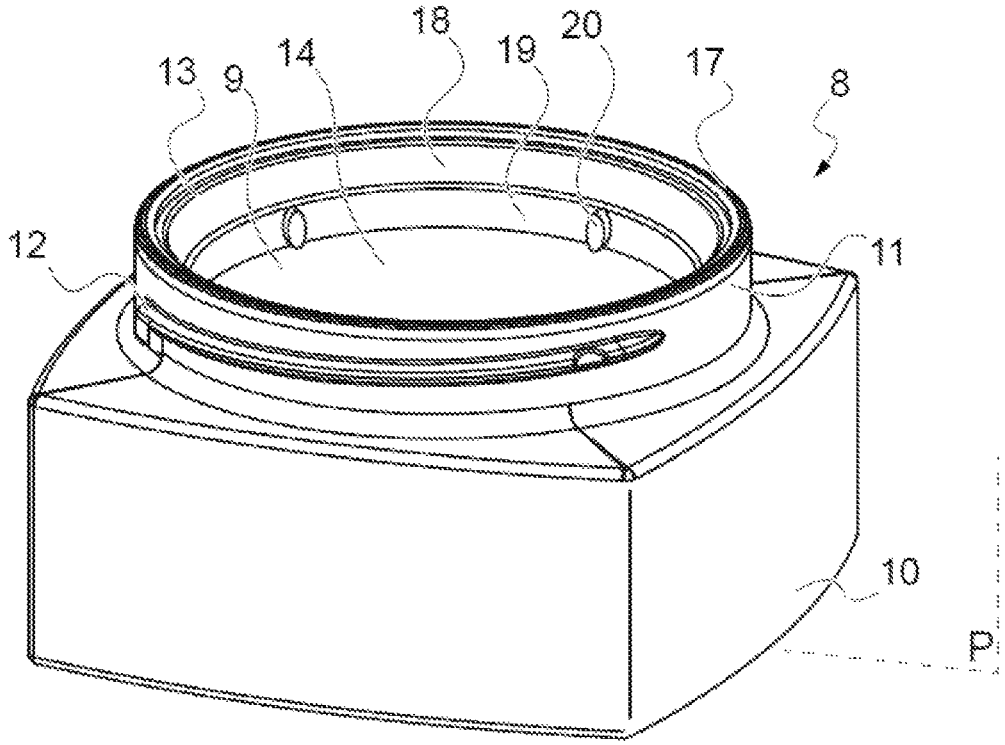

[Fig. 3]
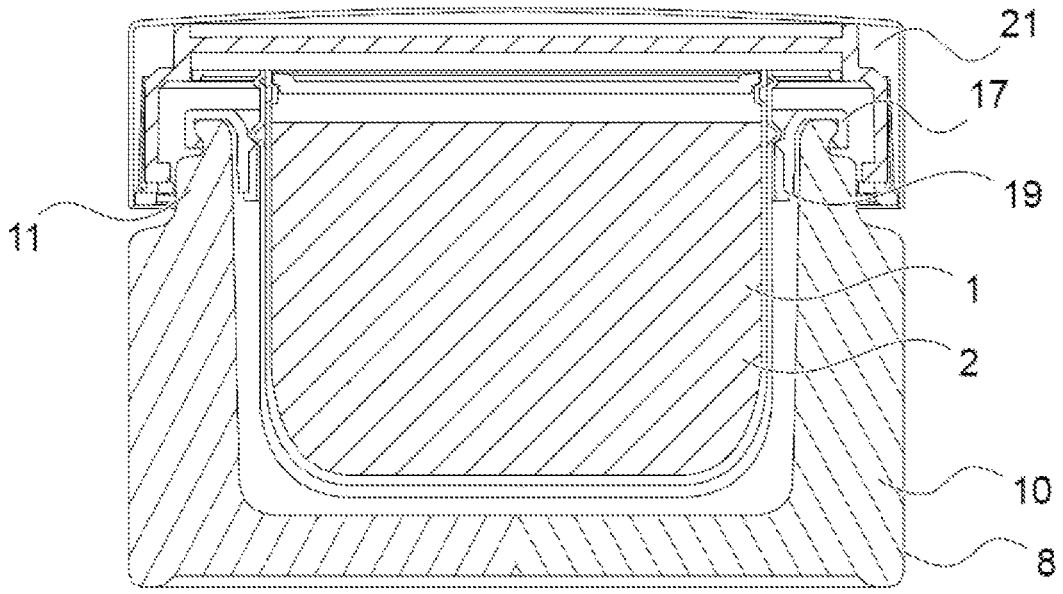
[Fig. 4]
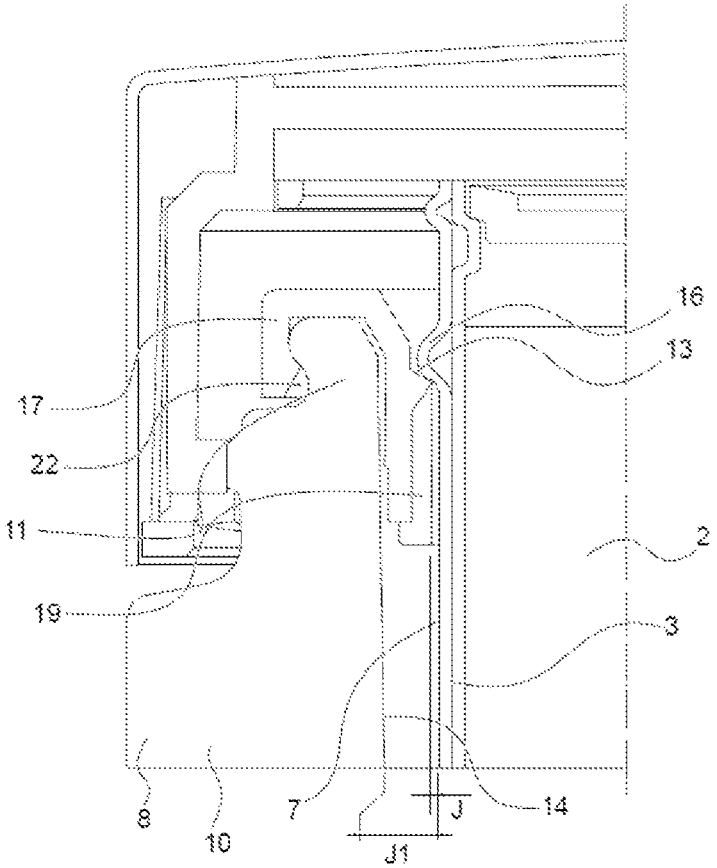

[Fig. 5]
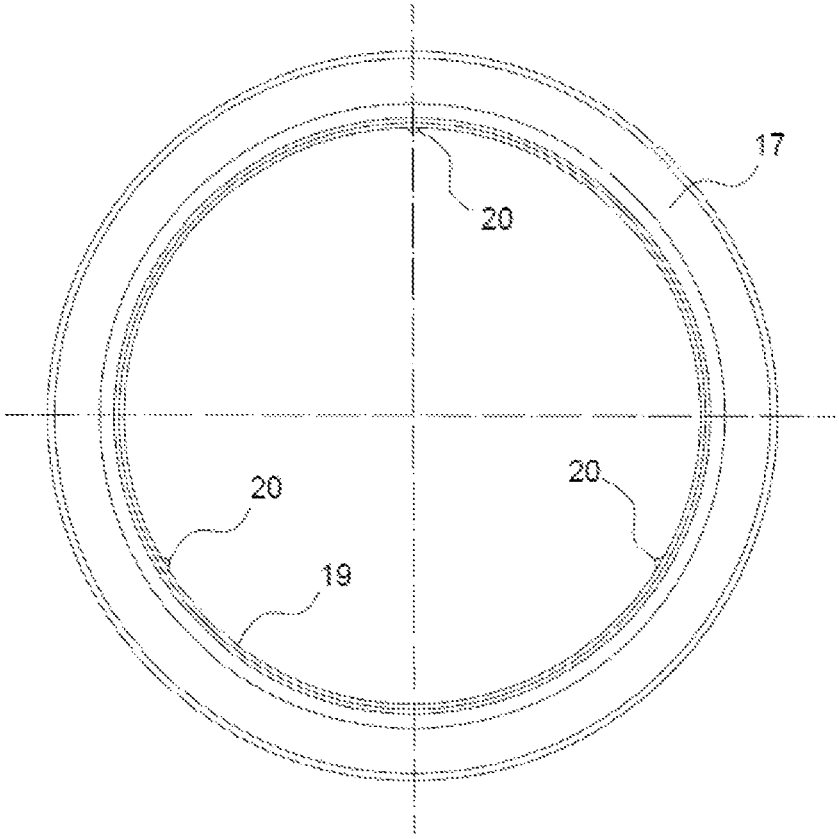

CASING FOR A REFILLABLE CONTAINER DEVICE FOR COSMETIC PRODUCT AND ASSOCIATED CONTAINER DEVICE

BACKGROUND

1. Field of the Invention

The present invention concerns the field of refillable container devices for cosmetic product. By cosmetic product is meant in particular all products for making up the skin, including the lips, and all compositions provided for application to the body, including what are referred to as care products such as moisturizing creams. It relates in particular to the field of refills for refillable container devices for cosmetic product.

A container device for cosmetic product designates in general terms any receptacle employed to contain a cosmetic product for its preservation, its transport, its commercialization, or its use. For example, pots, bottles, cases, etc., employed to contain a cosmetic product are so designated.

By refill is meant a removable member comprising a vessel adapted to contain a cosmetic product, and which can be put in place and removed from a casing which forms the outside surface of the refillable cosmetic product container device constituted by a casing and a refill.

Once in place in the casing, the refill must be properly held in the casing. In particular, it is to be avoided for the refill to be able to escape from the casing, when its is transported or used, at which times the pot may have any orientation, in particular the container device being completely turned over, whether this arises from a deliberate act or not. Furthermore, the refill should not move in the casing on use of the container device. The refill must stay fixed on dispensing of the product, for example when the user takes product from the refill.

Nevertheless, it must be possible for the refill to be extracted easily from the casing, for it to be replaced.

2. Description of the Background

Known refillable container devices generally comprise systems for holding the refill in the casing which are visible and have poor aesthetics, and/or which require adaptations which are industrially complex or costly.

Document JP2013119399 thus discloses a pot for cosmetic product comprising a refill of which the general shape of the vessel is that of a cylinder of revolution and comprises reliefs which slide, by virtue of matching shapes, in vertical grooves provided in the casing of the pot to prevent the vessel from turning.

Document EP0661012 also discloses a pot device having a refill, comprising an inside vessel or receptacle which engages by virtue of matching shapes in an outside receptacle forming a casing, it being possible in particular for the inside receptacle to comprise a peripheral bead which cooperates with a groove formed inside the neck of the outside receptacle.

Document WO2019058087 also discloses a pot device having a refill with a configuration that is close, comprising an inside vessel or receptacle which engages by virtue of matching shapes in an outside receptacle forming a casing, the casing comprising a peripheral bead which cooperates with a groove formed on the outside surface of the vessel. The upper part of the casing has a neck comprising slots in which are inserted radial beads of the vessel to enable the latter to be held against rotation.

Thus, the container devices having a refill that are known in the state of the art are based on matching of shapes between the casing and the refill, which makes it possible for example by dipping (that is to say snap engagement or other relative mechanical engagement) to hold the refill in the casing. This requires a particular shape of the casing and of the refill, which for example prevents use of a casing of conventional shape, such as a standard glass receptacle, to form a refillable container device, and similarly, prevents use of a refill in the form of a vessel of conventional shape, for example a vessel of glass or stainless steel of conventional shape.

The invention is directed to overcoming the aforementioned drawbacks in whole or in part.

SUMMARY

Thus, the invention relates to a casing for a refillable container device for cosmetic product which is configured to receive a refill configured to contain the cosmetic product. The casing comprises an opening forming a neck, this opening being configured to receive the refill in order to put it in place in a reception volume defined by an inside wall of the casing. The casing further comprises a ring connected to the neck, said ring extending over at least one portion of the inside wall of the casing forming said neck. The ring comprises an inside surface to which is connected a member of elastomer material which is at least partly in relief relative to said inside surface of the ring.

The casing so formed is able to hold in place a refill of suitable shape, by virtue of the member of elastomer material. The holding obtained, which nevertheless enables extraction of the refill, uses the elastic properties and the coefficient of friction of the elastomer material. The employment of the refill is thus very simple. As the member of elastomer material is carried on a ring that is mounted on and attached to the casing, the invention may be implemented on casings of very diverse constitutions and shapes.

The member of elastomer material may be molded onto the ring.

The ring may be formed from a plastics material. The ring and the member of elastomer material it possesses may be formed together by bi-material injection-molding.

The ring can thus be produced by industrial processes that are known and mastered, which provide good cohesion between the ring and the member of elastomer material it bears.

The elastomer material employed may for example be a thermoplastic elastomer or a silicone elastomer. It may have a hardness comprised between 20 degrees Shore and 80 degrees Shore, and preferably comprised between 40 degrees Shore and 60 degrees Shore.

The elastomer material employed and its hardness enable deformation thereof under a reasonable force, compatible with the application to a cosmetic product refill.

The member of elastomer material may form discrete projections distributed over the surface of the inside wall of the casing.

The member of elastomer material may form at least two projections and preferably at least three projections distributed over a periphery of the inside surface of the ring in the part thereof located on the surface of the inside wall of the neck of the casing.

The member of elastomer material may extend in one or more strips parallel to the opening of the casing.

Different configurations of the member of elastomer material make it possible to adapt the bearing zones to the application, the holding of the refill, the holding force, the aesthetics, the complexity of implementation, etc.

In such a casing, the reception volume can be of the general shape of a cylinder of revolution, or frusto-conical, or right prismatic.

These are configurations that are particularly suited to the implementation of the invention.

The casing may mainly consist of plastics material, of glass, of stainless steel, of aluminum, or of wood.

By mainly is meant more than 50% by volume. In particular, the casing may be formed from one of the aforementioned materials, except for the ring and the member of elastomer material. The casing is as a matter of fact imbued with an aesthetic aspect which may be of the utmost importance in the field of cosmetic products.

The ring may be connected to the neck of the casing by snap engagement and/or by bonding. Any other known manner of reliable rigid connection may be employed.

When bonding is performed between the ring and the neck, the bonding may be made between the ring and the outside wall of the casing, and/or between the ring and the inside wall of the casing, and/or on the periphery of the neck of the casing.

The invention also relates to a container device for cosmetic product comprising a casing as defined above and a refill in which the refill comprises a lateral wall having clearance with respect to the inside wall of the casing, except at the location of all or part of the member of elastomer material, such that bearing zones of the member of elastomer material on said lateral wall of the refill are formed.

As the holding of the refill in the casing is provided in bearing zones, the means enabling that holding may be invisible (if the casing is opaque) or at least very discrete, such that they are not detrimental to the aesthetics of the pot that is constituted.

The member of elastomer material may be deformed in said bearing zones by compression on the lateral wall of the refill, compared with a configuration that the member of elastomer material adopts when not acted upon externally.

The deformation of the member of elastomer material over the bearing zones increases the force it applies to the casing inside surface, and thereby increases the friction forces which oppose the extraction of the refill.

In one embodiment, the lateral wall of the refill is devoid of asperities such as snap-fastening rings, studs, apertures or grooves, at least in a zone of interaction of said lateral wall with the member of elastomer material. In particular, the lateral wall of the refill is devoid of any asperity below a member of the vessel configured to come to engage vertically on the casing (rim, peripheral bead, etc.).

Not being based on a snap-fastening or screwing principle, or other engagement of one member in a member of matching shape, the holding of the refill does not require there to be formed thereon any particular shape configured to cooperate with holding means of the casing.

In a container device as defined above, of which the refill vessel is filled with a cosmetic product, the casing and the refill may be configured such that a force required for the extraction of the refill is greater than or equal to twice, and preferably greater than or equal to two and a half times, the weight of the refill. In particular, the shape, the dimensions, and the constitution of the member of elastomer material are configured so as to obtain the force required for the desired extraction of the refill.

This holding force enables a relatively easy withdrawal of the refill for its replacement. It corresponds to a desirable specification for conventional pots for cosmetics products.

Lastly, in the container device as described above, the vessel may comprise a lid secured by snap-fastening or screwing to the rest of said vessel. This enables nomadic use of the vessel alone, without the casing, to transport the cosmetic product it contains.

The container device may in particular be a pot, for example a cream pot.

Still other particularities and advantages of the invention will appear in the following description.

BRIEF DESCRIPTION OF DRAWINGS

In the accompanying drawings, given by way of non-limiting example:

FIG. 1 shows, in a three-dimensional view, a first example of a refill that can be implemented in a container device for a cosmetic product in accordance with an embodiment of the invention;

FIG. 2 shows, in a three-dimensional view, a first example of a casing for a refillable cosmetic product container device according to a first example embodiment of the invention;

FIG. 3 shows, in a cross-section view, a cosmetic product container device, namely a pot, comprising the casing of FIG. 2 and the refill of FIG. 1;

FIG. 4 shows, in a partial view in cross-section, the interaction between the casing and the refill in the container device of FIG. 3;

FIG. 5 is a diagrammatic view of a ring implemented in the embodiment of the invention of FIGS. 2 to 4.

DETAILED DESCRIPTION

FIGS. 1 and 2 show a pot 1 according to an embodiment.

FIG. 1 shows, in a three-dimensional view, a first example of a refill 1 configured to be used in a refillable cosmetic product container device in accordance with an embodiment of the invention.

The refill 1 comprises a vessel 2 which is hollow, that is to say of which the shape forms a volume configured to receive a cosmetic product. In the example shown here, the vessel 2 has a cylindrical general shape, which may be right cylindrical or slightly flared (frusto-conical). Any hollow shape can however be envisioned to form the vessel, in particular any right prismatic shape, in particular having a shape that is square, rectangular, pentagonal, hexagonal, octagonal, etc.

The vessel 2 in particular has a lateral wall 3 and a bottom 4.

The vessel comprises, in the example shown, an upper edge 5. The edge 5 is formed around an open face 6 of the vessel 2.

According to an embodiment not represented, the edge 5 may jut, that is to say that it forms a rim at the periphery of the open face 6. Such a rim may enable the snap engagement of a lid over the vessel 2. Such a rim may also form a bearing zone for the vessel when it is inserted into a corresponding casing.

in the example embodiment represented here, the vessel 2 has a screw thread 15 enabling the adaptation of a lid screwed onto the vessel. The vessel 2 can thus be used alone, independently of the casing described below for FIG. 2, in order to transport the cosmetic product it contains.

A cosmetic product, for example a cream, may thus be contained in the volume formed inside the vessel.

The open face 6 of the vessel may be covered with a removable cap, for example a plate for protecting the product, for example bearing on the rim 5 and/or on a shoulder formed in the upper part of the vessel. The vessel may also comprise a closure, for example heat-sealed, covering the open face 6 and that has to be removed when the refill is first used. The open face may be unobstructed, directly exposing the product contained in the vessel 2 of the refill, or be equipped with a regulating device, such as a screen, a net, or other device configured for the product to dispense. The refill thus has a simple shape.

Here the refill, and in particular its lateral wall 3 and more particularly the outside surface 7 of that lateral wall 3, is devoid of asperities or other snap-fastening means.

By asperity is meant a volume, a member that is hollow or in relief, formed on a surface and of dimensions substantially greater than the possible roughness linked to the material constituting said surface. The lateral wall surface 3 comprises in particular no snap-fastening ring, no pin, no aperture or any groove.

In the example embodiment shown here, the lateral wall 3 nevertheless comprises a peripheral bead 16 giving a bearing surface. The lateral wall 3 is thus devoid of any means for snap engagement in relation to a casing configured to receive the vessel 2, as detailed below.

The refill can thus be produced easily, or may consist of a standard container, for example a pot of plastics, glass or stainless steel.

As refill, it is possible to employ a preexisting receptacle, for example a conventional glassware receptacle, with no adaptation, as a refill for a cosmetic product container device.

The manufacturing cost of the vessel (and ultimately of the container device) can thus be reduced, compared with container devices of which the vessel has to comprise specific members for fastening inside a casing.

FIG. 2 represents an example of a casing 8 that can be employed to form a container device for a cosmetic product (here, a pot) with a refill 1, for example the refill of FIG. 1.

The casing designates a member configured to receive a refill and in which the refill will be held. The casing of FIG. 2 thus forms a reception volume configured to receive the refill 1 by an opening 9. More particularly, an inside wall 14 of the casing 2 defines the reception volume of the vessel 2 of the refill 1.

The casing 8 comprises a main body 10. In the example shown, the main body 10 is substantially prism-shaped with a square base, of which the side faces are slightly convex. As the casing 8 constitutes a visible part of the pot once the latter has been constituted, it has an important aesthetic function. The main body 10 of the casing 8 is surmounted with a neck 11 provided with a screw thread 12 making it possible to fit in place a screw lid (not shown in FIG. 2).

A shoulder 13 is formed in the vicinity of the mouth of the neck 11. The shoulder 13 is dimensioned so as to be able to receive, bearing thereon, a member of the vessel 2 of the refill 1, namely the peripheral bead 16 in the example embodiment shown.

The shoulder 13 is optional, it being possible for the refill to bear vertically, in other embodiments, on other surfaces of the casing, for example a rim 5 of the vessel 2 of the refill 1 can bear directly on the neck 11, or for example in the absence of a rim on the vessel 2 of the refill, the bottom 4 of the vessel can bear on a bottom of the casing, if the latter comprises a bottom. A bottomless casing 8 may be advantageous to facilitate the extraction of the refill.

More particularly, according to the present invention the casing 8 comprises a ring 17 which is connected to the neck 11. The ring 17 covers the neck 11 in the example shown, and is connected to it by snap engagement. Other kinds of connection, such as bonding, may be used alternatively or in addition to snap engagement.

The ring 17 here comprises the shoulder 13 enabling the vertical bearing of the vessel 2 of the refill.

According to the invention, the ring 17 comprises an inside surface 18 to which is connected a member of elastomer material 19.

The member of elastomer material 19 is intimately connected to the ring 17.

Typically, the member of elastomer material 19 may be molded onto the ring 17.

Molding of the member of elastomer material 19 onto the ring 17 is in particular possible onto a ring 17 made from plastics material, in particular from hard plastics material such as polypropylene.

Alternatively, the ring 17 and the member of elastomer material 19 may be formed by bi-material injection molding.

The elastomer materials usable to form the member of elastomer material all comprise thermoplastic elastomers (TPE) as well as silicone elastomers. The usable materials advantageously have a Shore hardness comprised between 19 degrees Shore and 80 degrees Shore (preferably between 40 and 60 degrees Shore).

The hardness of the material employed is an important parameter for optimization, and is chosen in particular according to the dimensions of the vessel of the refill and according to the material used for forming the ring 17 and its configuration.

The member of elastomer material 19 is in relief relative to the inside surface 18 of the ring 17.

In other words, over at least part of the member of elastomer material 19, the latter is proud relative to the inside surface 18.

In the example embodiment shown, the member of elastomer material 19 forms a peripheral strip on the inside surface 18 of the ring. This strip comprises three projections 20, distributed along the periphery of the inside surface 18 bearing said strip.

These projections 20 form the parts of the member of elastomer material 19 having a function of holding the refill 1 in the reception volume, as detailed below.

The number, the dimensions, the shape, and the orientation of the projections 20 may vary according to the application considered. More generally, the configurations that can be envisioned for the member of elastomer material are numerous.

In the example embodiment shown, the projections 20 have a vertical arrangement, that is to say that they form a relief of elongate shape from top (opening of the neck 11 of the casing 8) to bottom (bottom of the casing 8 if said casing has a bottom).

More generally, the projections 20 are oriented perpendicularly to a plane materialized by the opening 9 of the casing provided for insertion of the refill 1. The projections 20 may thus be designed as gadroons, in this embodiment.

In this embodiment, the number of projections formed by the member of elastomer material may easily be adapted, with few modifications to the production tools.

With the exception of the projections 20 which are necessarily in relief relative to the inside surface 8 of the ring 17, the rest of the member of elastomer material 19 may be in relief or flush with the inside surface 18 of the ring 17.

The distribution of the three projections 20 is preferably regular, that is to say that the projections are equidistant along the strip formed by the member of elastomer material 19. They are thus formed with an angle of 120° between them, if the ring 17 is circular. More generally, when the ring 17 is shaped as a surface of revolution, this results in a regular angular distribution of the projections 20 in the ring.

While in the embodiment shown, the member of elastomer material 19 extends continuously in the form of a strip, over a periphery of the inside surface 18 of the ring 17, according to another variant of this embodiment, the member of elastomer material 19 may be formed from several projections 20 within them being connected together by a strip of elastomer material.

Numerous other configurations of the member of elastomer material 19 may be envisioned, for example a single strip in relief relative to the inside surface 18 of the ring, a strip of zig-zag or undulating shape, a combination of one or more strips and projections 20, etc.

The casing of FIG. 2 may be formed mainly (for example with the exception of the ring 17 and of the member of elastomer material 19) from various materials. For example, the casing may be formed of glass. Any tint of glass may be employed, in particular transparent, translucent, opaque, colored or not colored.

The casing may be formed from numerous other materials, according to the appearance sought, the volume, the shape, and the manner of closure desired, etc. In particular, the casing may be of plastics material, wood, metal (such as stainless steel, tinplate, or aluminum).

FIG. 3 shows, in a cross-section view, a container device, namely a pot, formed from the casing of FIG. 2 and from the refill of FIG. 1.

The container device shown in FIG. 3 is furthermore equipped with a lid 21 configured to cooperate with the screw thread 12.

The cross-section plane is a diametrical plane of the casing 8, as shown in FIG. 2.

The pot shown in FIG. 3 thus comprises a casing 8, in the form of a receptacle with a thick wall, which forms a reception volume in which the refill 1 is received.

In the example shown the shape of the inside volume of the casing 8 thus matches, with clearance being the only difference, the shape of the outside of the vessel 2 (for example cylindrical or slightly frusto-conical). The depth of this volume is slightly greater than the overall height of the refill 1, such that the peripheral head 16 of the refill bears on the shoulder 13 formed at the mouth of the neck 11.

FIG. 4 shows a detailed view of the interaction between the casing 8 and the refill 1 in the pot of FIG. 3, based on the same cross-section plane as that of FIG. 3.

FIG. 4 in particular shows the snap engagement of the ring 17 on the neck 11 of the vessel 2. To that end, the neck 11 may thus have a shape configured for the snap engagement, for example by virtue of a groove 22 formed in an upper part of the neck 11.

FIG. 4 also shows the bearing relationship formed between the peripheral bead 16 and the shoulder 13 of the ring 17.

The ring 17 extends along the upper part of the inside wall 14 of the vessel.

When a refill 1 is in position in the casing 8, in the example shown, its only interaction with the casing is with the ring 17.

As a matter of fact, there is an amount of clearance J1, for example of the order of 1 to 3 mm for a pot of cosmetic cream of conventional volume, for example of the order of 60 mL, between the inside wall 14 of the casing 8 and the outside surface 7 of the lateral wall 3 of the vessel 2.

The member of elastomer material 19 is provided on the inside surface of the ring 17. In the example shown there is a clearance J between the member of elastomer material 19 and the outside surface 7 of the lateral wall 3 of the vessel 2, with the exception of the zones projecting from said element of elastomer material 19. In practice, each projection 20 forms a projection of a thickness greater than the clearance J, when the projection is not subjected to an external mechanical stress, in particular when the projection 20 does not deformed by compression.

For example, the thickness of the projection may be of the order of 1 mm, for example of the order of 0.9 mm.

In order to insert the refill 1 into the casing 8 to attain the bearing relationship on the shoulder 13, it is necessary to deform the projections 20 to allow the insertion of the refill 1 into the casing 8.

When the refill 1 is in the casing 8, each projection 20 is compressed and thus has a thickness equal to the clearance J. The projection 20 thus fills up the clearance J and due to its elasticity applies a bearing force on the lateral wall 3 of the vessel 2 of the refill 1.

There are advantageously several bearing projections distributed around the vessel 2, so as to distribute the bearing over the lateral wall 3, and ensure effective and uniform holding of the vessel 2 in the casing 8.

An example of distribution of the projections can be seen in FIG. 5. FIG. 5 shows the ring 17 of the embodiment of FIGS. 2 to 4, seen from below, that is to say having in the foreground the face of the seal oriented towards the bottom of the casing when the ring 17 is connected to the casing. The three projections 20 regularly spaced, with an angle of 120° between them, enables uniform holding and perfect centering of the vessel 2 when it is in place in the casing 8, in interaction with the ring 17.

Each bearing zone, formed at the location of each projection 20, forms a zone ensuring holding of the vessel 2 (and thus of the refill 1) in the casing 8. When a force tending to extract the refill 1 from the casing 8 is applied, a force opposing its extraction is created, by reaction, at the location of the projections, on account of the interaction between each projection 20 and the lateral wall 3 of the refill 1 onto which the projections 20 are compressed. This force is generated by friction of the projection 20 on the outside wall of the vessel 2.

So long as the vessel 2 is immobile in the casing 8, this is a so-called dry friction force, of which the intensity is, for each projection 20, at most equal to the coefficient of static friction between the projections 20 multiplied by the force applied between the inside wall 14 of the casing 8 and the projection 20 due to its compression. When the force tending to extract the vessel from the casing 8 exceeds the sum of the maximum forces of static friction applied at the location of the projections 20, the refill 1 begins to move relative to the casing 8 for its extraction.

It thus appears that the number of projections, their dimensions, the elastomer material employed, as well as the material constituting the vessel 2 and the state of the outside surface 7 of the lateral wall 3 of the vessel are parameters which make it possible to modulate the force required for the putting in place and for the extraction of the refill 1.

As regards the member of elastomer material 19, the material it constitutes, the total bearing surface area (sum of the bearing surface areas) between said member of elastomer material and the outside surface 7 of the lateral wall 3 of the vessel, and the sum of the forces applied on account of the compression of said member of elastomer material are crucial parameters when determining the configuration for the member of elastomer material.

Whatever the embodiment considered, it is recommended, for a pot of cosmetic product, for the force required for the extraction of the refill to be at least two times greater than the weight of the full refill, for example of the order of two and a half times the weight of the full refill.

The presence of at least three regularly distributed projections, as in the example shown in FIG. 5, furthermore enables the centering of the refill in the casing 8, as mentioned above.

In order to facilitate the putting in place of the refill 1 in the casing 8, the projections 20 have, in the example shown, a shape that is domed in the so-called vertical direction which, furthermore, corresponds to the direction of insertion (and of extraction) of the refill, which enables progressive compression of the projections on insertion of the refill 1 into the casing 8. The projections 20 could alternatively have a beveled or chamfered shape to obtain the same effect.

The present invention is of course not limited to the embodiment detailed above. In particular, the respective configuration of the member of elastomer material, of the refill and/or of the casing may be very different from the configurations described above. For example, the presence of projections on the member of elastomer material is optional, provided that at least part of said member of elastomer material is in relief relative to the inside surface of the casing. Very varied forms of members of elastomer material may be envisioned.

Several distinct members of elastomer material may be present on a same casing.

The vessel may have varied shapes and constitutions according to the application considered. Similarly, the casing can have varied shapes and constitutions.

For example, the vessel may be cubic, cylindrical, cubic or parallelepiped, spherical, and may or may not have a bottom, or be provided with an aperture in its bottom to facilitate the extraction of a refill.

The invention thus developed enables the removable holding of a refill of cosmetic product in a casing in order to form a cosmetic product container device that is aesthetic and refillable by exchanging the refill. The holding is obtained by friction of the member of elastomer material on an outside surface of a wall of the refill. The holding means, in particular the member of elastomer material, may be totally invisible once the pot has been constituted, and be inconspicuous in the casing.

Furthermore, the refill may have a shape that is simple to produce, since the outside surface of the vessel of the refill which is provided to interact with the member of elastomer material of the casing for the holding of the refill does not require the formation of any particular mechanical device for snap engagement. A preexisting receptacle, for example a conventional glassware receptacle, a simple vessel of plastic, of metal etc. may thus be employed without adaptation as a vessel for the refill of the cosmetic product container device.

The invention claimed is:

1. A container device for a cosmetic product comprising:

a casing for a refillable container device for a cosmetic product, the casing being configured to receive a refill configured to contain the cosmetic product the casing comprising:

an opening forming a neck of the casing and which is configured to receive the refill in order to put it in place in a reception volume defined by an inside wall of the casing; and a ring being connected to the neck, the ring extending over at least one portion of the inside wall of the casing forming the neck, wherein the ring includes an inside surface to which is connected a member of elastomer material which is at least partly in relief in relation to the inside surface of the ring; and a refill comprising a lateral wall having clearance with respect to the inside wall of the casing, except at the location of all or part of the member of elastomer material, such that bearing zones of the member of elastomer material on the refill are formed, the member of elastomer material being in contact in the bearing zones with the refill lateral wall without snap-fastening into the refill lateral wall, and holding of the refill in an immobile state in the casing is obtained only by static friction of the member of elastomer material on an outside surface of a wall of the refill.

2. The container device according to claim 1, wherein:

the member of elastomer material is deformed in said bearing zones by compression on the lateral wall of the refill compared with a configuration that the member of elastomer material adopts when not acted upon externally.

3. The container device according to claim 1, wherein:

the lateral wall of the refill is devoid of asperities including one or more of the following: snap-fastening rings, studs, apertures or grooves, at least in a zone of interaction of said lateral wall with the member of elastomer material.

4. The container device according to claim 1, wherein:

the shape, the dimensions and the constitution of the member of elastomer material are configured such that a force required for the extraction of the refill from the casing is greater than or equal to twice, and preferably greater than or equal to two and a half times, the weight of the refill.

5. The container device according to claim 1, wherein:

the member of elastomer material is molded onto the ring.

6. The container device according to claim 1, wherein:

the ring is formed from a plastics material, wherein the ring and the member of elastomer material connected to it are formed together by bi-material injection-molding.

7. The container device according to claim 1, wherein:

the elastomer material is a thermoplastic elastomer or a silicone elastomer.

8. The container device according to claim 1, wherein:

the elastomer material has a hardness comprised between 20 degrees Shore and 80 degrees Shore, and comprised between 40 degrees Shore and 60 degrees Shore.

9. The container device according to claim 1, wherein:

the member of elastomer material forms discrete projections distributed over the inside surface of the ring.

10. The container device according to claim 1, wherein:

the member of elastomer material extends in one or more strips parallel to the opening of the casing.

11. The container device according to claim 1, wherein:

the reception volume is the general shape of a cylinder of revolution, or frusto-conical or right prismatic.

12. The container device according to claim 1, wherein:

the casing is comprised of plastics material, of glass, of stainless steel, of aluminum, or of wood.

13. The container device according to claim 1, wherein:

the ring is connected to the neck by snap engagement and/or by bonding.

14. The container device according to claim 1, wherein:

the member of elastomer material extends proud from a surface of the ring and forms a peripheral strip on the inside surface; and the peripheral strip comprises a plurality of projections distributed along the strip.

15. The container device according to claim 1, wherein:

a peripheral bead extends around the refill;

a shoulder is formed on the ring; and the peripheral bead of the refill bears on the shoulder.

* * * * *